United States Patent [19]

Paulsen et al.

[11] Patent Number: 4,592,377

[45] Date of Patent: Jun. 3, 1986

[54] COIN ESCALATOR

[75] Inventors: Craig A. Paulsen; Thomas R. Meier, both of Reno, Nev.

[73] Assignee: IGT, Reno, Nev.

[21] Appl. No.: 626,946

[22] Filed: Jul. 2, 1984

[51] Int. Cl.[4] ..... B80B 7/00; B08B 7/00; G07F 3/02; A47F 1/04

[52] U.S. Cl. ..... 133/5 R; 133/8 R; 221/66; 221/301

[58] Field of Search ..... 133/1 R, 5 R, 8 R, 8 E; 198/491, 492; 193/DIG. 1, DIG. 2, 38, 25 FT; 194/1 E, 1 K, 97 R; 221/66, 247, 301, 307, 267

[56] References Cited

U.S. PATENT DOCUMENTS

| | | | |
|---|---|---|---|
| 3,107,767 | 10/1963 | Medoff et al. | 193/25 FT |
| 3,910,295 | 10/1975 | Fletcher | 133/8 E X |
| 4,437,478 | 3/1984 | Abe | 133/5 R |
| 4,475,564 | 10/1984 | Koester et al. | 133/8 R |
| 4,511,060 | 4/1985 | Lindsey | 221/301 X |
| 4,518,001 | 5/1985 | Branham | 133/5 R |

FOREIGN PATENT DOCUMENTS

| | | | |
|---|---|---|---|
| 3228576 | 2/1984 | Fed. Rep. of Germany | 194/1 K |
| 878546 | 10/1961 | United Kingdom | 133/8 R |

OTHER PUBLICATIONS

Kay, John G. "Escapements for Automatic Parts Handling", *Automation* Mar. 1966; pp. 83–88.

U.S. patent application Ser. No. 336,836, filed 1/4/82, by Harold E. Koester et al., for Improved Coin Handling Apparatus.

*Primary Examiner*—Joseph J. Rolla
*Assistant Examiner*—Gregory L. Huson
*Attorney, Agent, or Firm*—Townsend & Townsend

[57] ABSTRACT

A coin handling apparatus for receiving coins at one end of a coin transport channel, feeding the coins through the channel in single edge-to-edge file and discharging the coins through an outlet slot at the outlet end of the channel is disclosed. A security device located at the outlet end of the channel is in contact with a first coin next to the outlet slot and a second coin farther from the outlet slot. The security device prevents the first coin from being discharged through the outlet slot unless the first and second coins move simultaneously and with substantially equal speeds toward the outlet slot.

19 Claims, 5 Drawing Figures

COIN ESCALATOR

BACKGROUND OF THE INVENTION

This invention relates to coin handling in payout apparatus such as slot machines or similar gaming or amusement devices and in particular to a secure ejecting device for such apparatus which prevents coins from being stolen from the apparatus.

Gaming devices often use an elongated duct to transfer coins from a payout hopper to a coin tray, such as when the coin tray is elevated from the hopper. In one such design, coins are pushed through the duct by the hopper and out an outlet slot at the end of the duct into a payout tray. A pin with a roller which is held in place by a spring prevents the coin nearest the slot from going through the outlet slot until pressure is applied to the roller by an upwardly moving column of coins during a payout. When a coin pushes against the roller, the spring stretches and the roller moves, allowing the coin to exit. As a coin exits, the spring pulls the roller back into a position to block the next coin while imparting velocity to the exiting coin. A drawback of this mechanism is that coins can be stolen by inserting a paper clip or other device into the outlet slot and pushing the roller back while "fishing" out a coin.

In certain gaming devices of the type described above, a counter is placed on the payout hopper near where the hopper connects to the elongated duct to count the correct number of coins during a payout. Because of the varying diameters of tokens used by various casinos, the stack height of coins in the elongated duct between the counter and the outlet slot of the duct could vary by as much as ¼ inch or more. This variation can result in counting errors and thus overpays or underpays during a coin payout.

SUMMARY OF THE INVENTION

The invention is a coin handling apparatus for receiving coins at one end of a coin transport channel, feeding the coins through the channel in single edge-to-edge file and discharging the coins through an outlet slot at the outlet end of the channel. A security device located at the outlet end of the channel is in contact with a first coin next to the outlet slot and a second coin farther from the outlet slot. The security device prevents the first coin from being discharged through the outlet slot unless the first and second coin move simultaneously and with substantially equal speeds toward the outlet slot.

In a preferred embodiment, the security device is a rocker arm located at the end of the channel with a first and second pin extending through the channel for contacting a first and second coin, and with a pivot around which the rocker arm rotates. When a coin is being ejected, the first pin rolls along the edge of the first coin away from the outlet slot, while the second pin rolls along the edge of a second coin towards the center of the channel into the "V" area between the second coin and a third coin. After the first coin is ejected, the rocker arm is returned to its original position by a spring. In this position, the first coin cannot be pulled from the outlet slot by a thief because it is blocked by the first pin. The thief cannot simply push the first pin back as in previous designs because the rocker arm rigidly connects the first pin to the second pin and the second pin will not move while it is blocked by the second coin, and it will be blocked by the second coin until the coins are forced through the channel during a payout.

A counter is placed near the outlet slot, rather than close to the hopper, to prevent counting errors due to varying heights of the stack of coins in the duct. The counter is activated each time the rocker arm pivots. When the counter reaches the number of coins to be ejected, no more coins are fed into the channel by the hopper.

The second pin can cause binding of the coins in the channel if the diameter of the coins varies because the second pin is located so that it will engage the periphery of an ideal diameter coin. This binding is eliminated by adjustably mounting the second pin in a slot in the rocker arm. The slot allows the roller to "float" and adjust to differences in the location of the "V" areas between the second and third coins as a result of coin stack height variations due to differences in the coin diameter, thereby preventing the coins from binding up.

DETAILED DESCRIPTION OF THE INVENTION

Figure 1:
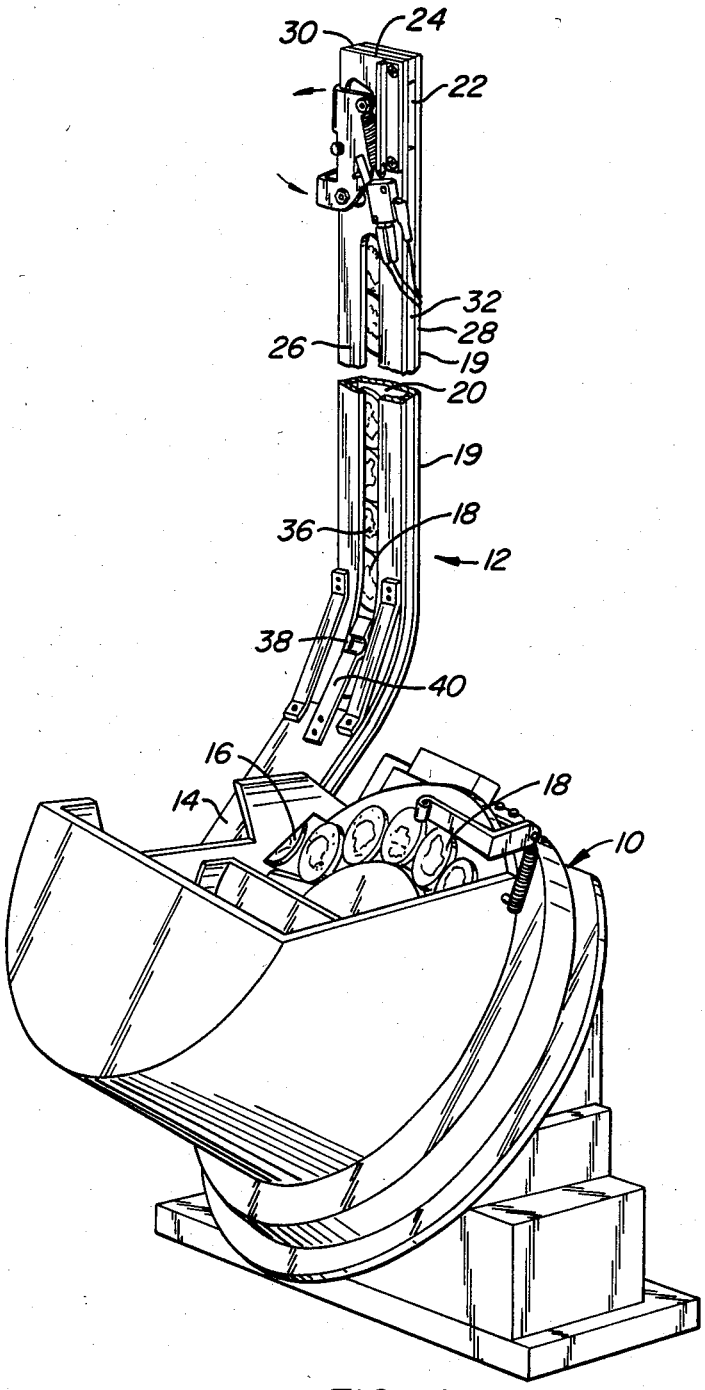
FIG. 1 is a perspective view of a coin hopper and the coin transport channel incorporating the present invention.

The present invention is best understood in connection with a specific coin hopper and coin transport mechanism. As illustrated in FIG. 1, there is shown a hopper 10 to which is secured a coin handling escalator assembly 12. The escalator is secured to the hopper adjacent its lower end 14 having an inlet 16 at the lower end through which coins 18 are received from the hopper. The escalator assembly comprises an elongated duct 19 having a channel 20 in which the stack of coins of a single given denomination are received in an edge-to-edge file and an outlet slot 22 adjacent the upper end 24 of the duct.

Duct 19 is made up of a front plate 26, a back plate 28 and a pair of edge panels or guides 30 and 32 secured together to define channel 20. Channel 20 has a depth between the front and back plates 26 and 28 greater than the thickness of the coin denominations handled by the escalator, but less than twice the thickness of the coins, thereby preventing the possibility of a coin slipping behind or in front of an adjacent coin which would cause them to jam in the channel. Of course, the width of channel 20 between edge panels 30 and 32 is also slightly greater than the diameter of the coins.

Front plate 26 has an access opening 36 along a substantial portion of its length allowing jamming or other interruption of the movement of coins therealong to be readily obviated by inserting a screwdriver or other similar tool. This opening may also or alternately be present on back plate 28. An enlarged access opening 38 is preferably provided between upper and lower portions of front plate 26 into which a leaf spring 40 (or other suitable retention means) extends for urging the coins against the opposite back plate 28. The enlarged opening 38 is of a size sufficient to allow coins to be extracted through the opening, for example, to empty the channel, for maintenance of the like.

Figure 2A:
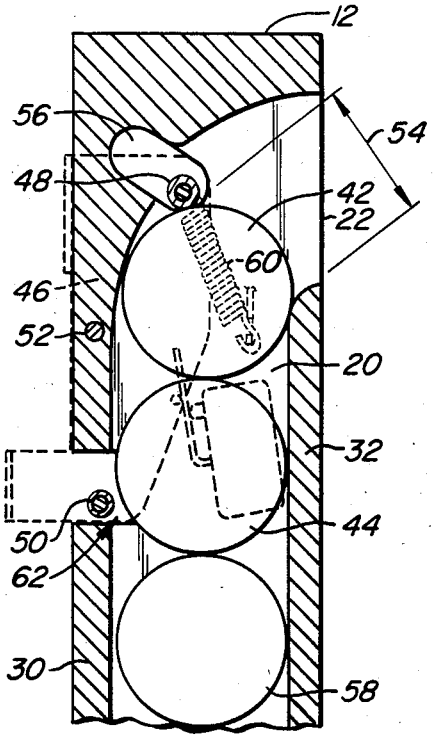
FIGS. 2A–C are section views of the upper end of the coin transport channel, partially broken away, illustrating successive steps in the ejection of a coin.
Figure 2B:
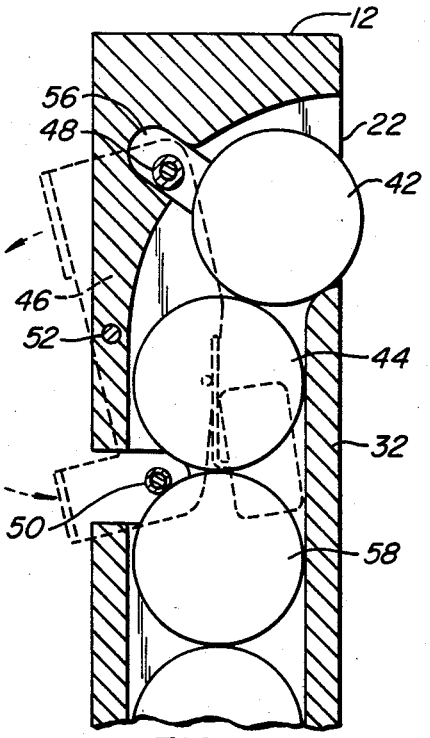
Figure 2C:
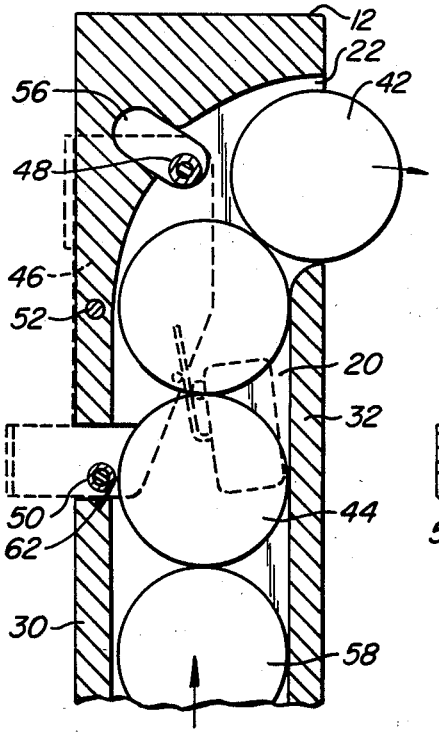

FIGS. 2A–C show a partially broken away view of the outlet end of escalator assembly 12. A first coin 42 and a second coin 44 are positioned in channel 20 near outlet slot 22. A rocker arm 46 is shown in phantom with a first roller 48 contacting first coin 42, and a second roller 50 for contacting second coin 44. The rocker arm is pivotable about shaft 52.

Before the ejection of a coin, rocker arm 46 is in the position shown in FIG. 2A where a distance 54 between first roller 48 and edge panel 32 is less than the diameter of a coin, thereby preventing the coin from being "fished" out of coin channel 20. With channel 20 filled with a stack of edge-to-edge coins, hopper 10 dispenses coins into the inlet at the lower end of the channel as illustrated in FIG. 1 when coins are to be paid out. As a new coin is forced into channel 20 from hopper 10, the stack of coins is advanced upwardly so that the uppermost coin 42 forces roller 48 away from slot 22 along a recess 56 in backplate 28. As rocker arm 46 pivots in a counterclockwise direction, roller 50 moves towards the center of channel 20 and enters into the "V" area between coin 44 and coin 58. The upward movement of the stack of coins in the channel thus forces coin 42 through outlet slot 22, which is unobstructed by roller 48 while roller 50 is in the "V" area, as shown in FIGS. 2B and 2C.

Rocker arm 46 is then returned to its original position after coin 42 has been ejected through the combination of spring 60 and coin 58 coming into contact with roller 50 and forcing it back into a slot 62 in edge panel 30. As coin 58 forces roller 50 back into slot 62, coin 44 is coming into contact with roller 48 at the position closest to the outlet slot 22 as shown in FIG. 2A. If more coins are to be ejected, the stack of coins continues to be pushed upward and the process repeats itself, otherwise the stack stops being pushed forward and the coins rest in the position shown in FIG. 2A.

While in the position shown in FIG. 2A, coin 42 cannot be fished out of the outlet slot 22 because roller 48 cannot be pushed back into slot 56 while coin 44 is restraining roller 50 from moving, thereby keeping rocker arm 46 from pivoting.

Figure 3:
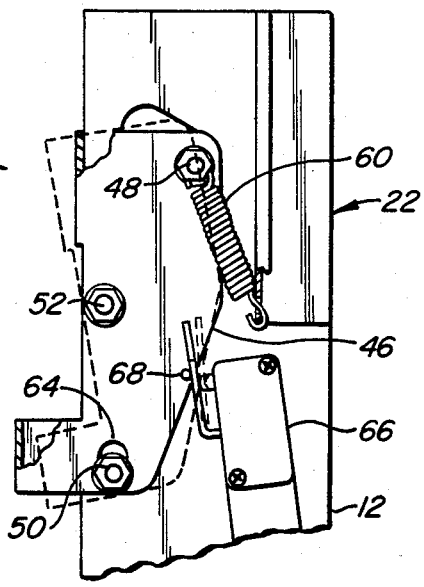
FIG. 3 is a fragmentary elevational view of the upper end of the coin transport channel showing the preferred construction of the invention.

FIG. 3 shows the preferred configuration of rocker arm 46. A slot 64 in rocker arm 46 allows roller 50 to "float", which allows the roller 50 to adjust to different relative positions of "V" areas between coins in the position of coins 44 and 58 in FIG. 2A. This floating ability prevents the coins from jamming against roller 50 and/or preventing rocker arm 46 from returning to its rest position due to variations in the diameters of the coins.

Also shown in FIG. 3 is a counter 66 which counts the coins ejected through outlet slot 22. By placing counter 66 at the top of coin escalator 12, rather than at the bottom, possible counting inaccuracies due to varying diameters of the coins are avoided. Counter 66 is activated by a pin 68 attached to rocker arm 46 which activates the counter each time the rocker arm pivots through one full cycle.

The use of spring 60, which biases rocker arm 46 back to its rest position, also serves the purpose of imparting greater speed to the coin as it is ejected through outlet slot 22. This keeps the outlet slot opening clear of coins which might otherwise accumulate during a multiple coin payout. Preferably, spring 60 is strong enough so that the coin will be propelled up to six to eight inches from the slot within a coin payout tray (not shown). It is also important that roller 48 be located in a position offset relative to the center of channel 20. In this position it is closer to the side of channel 20 opposite outlet slot 22 so that the coin coming into contact with it will tend to force it away from the outlet slot.

In the preferred embodiment, rollers 48 and 50 have an axle in the form of a pin, or shank of a bolt, extending through rocker arm 46 and channel 20, with the opposite end secured by a nut or the like for retaining the roller. Pivot 52 is substantially equally spaced from roller 48 and roller 50, so that the rollers travel equal distances along the edges of coins 42 and 44 when the rocker arm pivots because the coins move with substantially equal speeds through channel 20.

Counter 66 is connected to a controller (not shown) which controls the motor (not shown) driving the hopper and forcing the coins into coin escalator 12, so that when the counter reaches a predetermined number the motor is shut off and no more coins are forced into the coin escalator.

In operation, when a coin payout is to be made, a controller directs a hopper motor to start, and coins are forced into channel 20 with coin 42 pushing against roller 48 causing rocker arm 46 to pivot. As the center of coin 42 passes roller 46, spring 60 pulls rocker arm 46 back into its original position and pulls roller 46 against coin 42 causing it to be ejected through outlet slot 22 with the force of the spring. As the rocker arm rotates, member 68 activates counter 66, which sends a count signal to the controller. The process is repeated until the controller determines that the correct number of coins have been ejected and the hopper motor is stopped so that no more coins are forced into the channel and the rocker arm rests in its original, secure position.

While the invention has been shown and described with reference to a preferred embodiment thereof, it will be understood by those skilled in the art that various changes in form and detail may be made therein without departing from the spirit and scope of the invention.

We claim:

1. A coin handling apparatus for receiving coins at a first location and discharging the coins at a second location through a coin discharge slot remote from the first location, the apparatus comprising:

means defining a coin transport channel extending from the first location to the second location and dimensioned so that coins can move therein in a single, edge-to-edge file, the channel terminating at the coin discharge slot at the second location; and security means disposed within the channel and in contact with at least a first coin disposed proximate the slot and a second coin relatively remote from the slot for preventing a discharge of the first coin through the slot unless the first and second coins move simultaneously and with substantially equal speeds toward the slot.

2. A coin handling apparatus according to claim 1 and additionally comprising means operatively coupled with the security means for ejecting the first coin through the slot after it passes the security means at a speed greater than the speed at which the first and second coins move through the channel.

3. A coin handling apparatus according to claim 1 and additionally comprising a counter proximate to the discharge slot for counting the number of coins discharged through the slot, and means coupled with the security means for activating the counter each time a coin is discharged through the slot.

4. A coin handling apparatus according to claim 1 wherein the first and second coins are the coins closest to the discharge slot.

5. A coin handling apparatus accpording to claim 1 wherein the security means comprises a rocker arm, first and second members secured to the rocker arm for contacting peripheries of the first and second coins, respectively, and means mounting the rocker arm for pivotal movements about a pivot axis.

6. A coin handling apparatus according to claim 5 wherein the pivot axis is substantially equally spaced from the first and second members.

7. A coin handling apparatus according to claim 6 wherein the second member is movable relative to the rocker arm over a limited distance to accommodate differences in the stack height of coins in the channel due to variations in the diameters of the coins in the channel.

8. A coin handling apparatus adapted to be used with a coin payout assembly for the payout of coins at a location remote from the payout assembly comprising:

a duct defining an elongated channel dimensioned to receive from the payout assembly and permit the passage of coins of a given denomination in a single, edge-to-edge file to a coin discharge slot at an end of the duct remote from the payout assembly;

security means cooperating with the duct and having first and second coin contacting members disposed within the channel and located proximate the discharge slot, the members being positioned with respect to each other so that the members respectively contact a first coin closest to the discharge slot and a second coin; and release means interconnecting the members and permitting movement of the members relative to the channel so that movement of the first coin towards and through the discharge slot is conditioned on a corresponding, simultaneous movement of the second coin through the channel towards the slot.

9. Apparatus according to claim 8 wherein the members engage the peripheries of the first and second coins, and wherein the release means includes mounting means permitting simultaneous movement of the members along the peripheries of the respective first and second coins as the coins move simultaneously through the channel towards the discharge slot.

10. Apparatus according to claim 8 wherein the first and second coins are the coins closest to the discharge slot.

11. Apparatus according to claim 8 and further comprising a counter for counting the number of coins discharged through the slot, and means coupled with the release means for activating the counter each time a coin is discharged through the slot.

12. Apparatus according to claim 8 wherein the first member contacts a coin at a first position less than the diameter of a coin from the discharge slot.

13. Apparatus according to claim 12 wherein the first member is urged in the first position by a biasing means.

14. Apparatus according to claim 8 wherein the release means comprises means permitting pivotal movement of the members about a pivot axis oriented substantially perpendicular to the sides of the coins in the channel.

15. Apparatus according to claim 14 wherein the last mentioned means comprises a rocker arm.

16. Apparatus according to claim 15 wherein the members comprises rollers mounted to the rocker arm, and including means permitting variations in the spacing between the rollers.

17. Apparatus according to claim 16, wherein the means permitting spacing variations comprises a shaft mounting one of the rollers, and an elongated slot in the rocker arm through which the shaft extends and over the length of which the shaft can move.

18. A coin handling apparatus adapted to be used with a coin payout assembly for the payout of coins at a location remote from the payout assembly comprising:

a duct defining an elongated channel dimensioned to receive from the payout assembly and permit the passage of coins of a given denomination in a single, edge-to-edge file to a coin discharge slot at an end of the duct remote from the payout assembly;

a rocker arm with a pivot axis oriented substantially perpendicular to the sides of the coins in the channel connected to the duct proximate the discharge slot having a first and second roller disposed within the channel and being positioned with respect to each other so that the rollers respectively contact a first coin closest to the discharge slot and a second coin immediately next to the first coin;

a shaft mounting the second roller extending through an elongated slot in the rocker arm over the length of which the shaft can move; and biasing means for urging the first roller towards the discharge slot.

19. The apparatus according to claim 18 further comprising:

a counter located proximate to the discharge slot for counting the number of coins discharged through the discharge slot; and means coupled with the rocker arm for activating the counter each time a coin is discharged through the discharge slot.

* * * * *